US006505357B2

(12) United States Patent
Whatmore

(10) Patent No.: US 6,505,357 B2
(45) Date of Patent: Jan. 14, 2003

(54) POOL WINTERIZING METHOD AND APPARATUS

(76) Inventor: Paul Whatmore, 860 Queenston Road, Stoney Creek, Ontario (CA), L8G 4A8

( * ) Notice: Subject to any disclaimer, the term of this patent is extended or adjusted under 35 U.S.C. 154(b) by 0 days.

(21) Appl. No.: 09/902,639

(22) Filed: Jul. 12, 2001

(65) Prior Publication Data

US 2002/0016987 A1 Feb. 14, 2002

Related U.S. Application Data

(60) Provisional application No. 60/220,817, filed on Jul. 25, 2000.

(51) Int. Cl.[7] ..... E04H 4/00
(52) U.S. Cl. ..... 4/496; 4/504; 4/507
(58) Field of Search ..... 4/490, 496, 507, 4/509–511, 492, 488, 504

(56) References Cited

U.S. PATENT DOCUMENTS 3,828,932 A * 8/1974 Schneer
4,368,550 A * 1/1983 Stevens
4,718,129 A * 1/1988 Miller ..... 4/490
5,225,075 A * 7/1993 Cunningham
5,269,913 A * 12/1993 Atkins ..... 4/490
5,577,274 A * 11/1996 Plotsky et al. ..... 4/507
6,003,163 A * 12/1999 Celeste ..... 4/496
6,022,481 A * 2/2000 Blake ..... 4/507

* cited by examiner

*Primary Examiner*—Charles R. Eloshway

(57) ABSTRACT

A modified skimmer lid for use with a pool pump assembly having a pump, a skimmer chamber and a removable skimmer lid for the skimmer chamber, the modified skimmer lid comprises a skimmer lid base adapted to seal and mate with said skimmer chamber, a compressed air inlet integrally part of said modified skimmer lid for communicating and introducing compressed air into said skimmer chamber and for purging existing pool lines with compressed air, such that existing water lines need not be disturbed or removed.

13 Claims, 8 Drawing Sheets

POOL WINTERIZING METHOD AND APPARATUS

This application claims the benefit of provisional application No. 60/220,817 filed Jul. 25, 2000.

FIELD OF THE INVENTION

This invention relates to a method and apparatus for winterizing swimming pools.

1. Background of the Invention

Swimming pools consist of many various types, including in ground and above ground. In areas of the country where freezing conditions occur during the winter months, swimming pool owners must take certain steps to prevent the plumbing lines and the recirculating system from freezing which could potentially cause damage to the equipment and/or crack or burst pluming lines and/or other equipment.

In the past the most popular method of winterizing a pool was to treat the water with winterizing chemicals, lower the level of the swimming pool, water below all intake and return lines, drain all conduits and then seal off all openings. The problems inherent with this prior art method are to full. First by lowering the level of the water, below all intake and return lines, many thousands of gallons of water are wasted every year. Secondly, a considerable amount of time and effort is required to perform this job. Finally, there are technical implications to lowering the water, in that some in ground pools depend on the pressure of the water on the side walls to keep the side walls in place. Lowering the water level in the pool increases the dangers of collapse of the side walls and/or damage to the pools and/or to the structure of the pool itself.

In addition to lowering the level and draining the water lines from the pool, often a professional must be called into disconnect certain plumbing lines and they inject pressurized air in order to ensure that all plumbing and equipment containing water has been thoroughly purged of any subsisting water. The difficulty inherent with carrying out this procedure, is the fact that a professional normally needs to be called in, in order to carry out the procedure. In addition, plumbing lines normally have to be removed and the inherent problems with damage to plumbing lines when they are removed and reconnected with their fittings and in addition the problems with leaking that occurs. Finally, the supply of compressed air for injection into the system, requires sophisticated equipment that is only available to the professional rather than the home user thereby increasing the cost of winterizing the pool.

As a result there is a need for an inexpensive and quick method of winterizing a pool that can be carried out by the home owner without having to remove existing plumbing lines and/or having to purchase expensive equipment to repair the pool for the freezing months.

2. The Prior Art

The following pieces of prior art are relevant to the present invention. U.S. Pat. No. 577,274 titled Winterizing Check Valves System, David Plotsky, Nov. 26, 1996, describes a winterizing check valve system comprised of a cylindrical check valve having a hollow secure man portion and a housing portion.

U.S. Pat. No. 5,060,321, Pool Winterizing System, William J. Breneisen, issued Oct. 29, 1991, describes a Swimming Pool Winterizing System, including a straight hollow resilient plastic member for insertion into the skimmer discharge outlet.

U.S. Pat. No. 4,752,979 titled Swimming Pool Winterizing Device by Darell Goacher, Jun. 28, 1988, describes a device which will allow removal of water from the pipes and associated equipment servicing the swimming pool without partially draining the pool.

U.S. Pat. No. 4,368,550, titled Method and Apparatus for Winterizing a Swimming Pool by Gunther Stevens, issued Jan. 18, 1983, describes a method and apparatus to make it relatively easy for a swimming pool owner to economically and efficiently winterize the swimming pool.

U.S. Pat. No. 4,281,422 titled Swimming Pool Winterizing Disconnect Unit, by Louis Simonelli, issued Aug. 4, 1981 describes a disconnect unit for the isolation of the aqueous contents of a swimming pool from pump lines, permits contained water to be below clear said lines without need to remove an substantial quantity of waters from the pool.

SUMMARY OF THE INVENTION

The present invention a modified skimmer lid for use with a pool pump assembly having a pump, a skimmer chamber and a removable skimmer lid for the skimmer chamber, the modified skimmer lid comprises:

(a) a skimmer lid base adapted to seal and mate with said skimmer chamber; and (b) a conduit means for communicating and introducing compressed air from a source of compressed air into said skimmer chamber, and for purging existing pool lines with compressed air, such that existing water lines need not be disturbed or removed.

Preferably wherein said conduit means comprises:

(a) a compressed air inlet integrally part of said modified skimmer lid for communicating and introducing compressed air into said skimmer chamber.

Preferably wherein said compressed air inlet including a connection pipe for receiving and communicating compressed air into said skimmer chamber.

Preferably wherein said connection pipe adapted for communication of exhaust air received from a vacuum cleaner into said skimmer chamber.

Preferably further comprising:

(a) said skimmer lid base preferably including a planar base have a sealing surface for providing an air and water tight seal with said skimmer chamber;

(b) said planar base further including male attachment flanges cooperatively engaging with female apertures in said skimmer chamber for engaging one end of said modified skimmer lid; and (c) said planar base including bolt recesses preferably including bolt slots for receiving fastening bolts there through for releasably attaching said skimmer lid to said skimmer chamber.

Preferably in combination, the modified skimmer lid and a pool winterizing assembly comprising:

(a) a pump/filter assembly including said modified skimmer lid mounted on said skimmer chamber;

(b) a pool including at least one skimmer unit, and at least one water jet; wherein said skimmer and water jets communicating with said pump/filter assembly with water supply lines and water return lines; and (c) a source of compressed air communicating air to said modified skimmer lid and into said skimmer chamber for purging residual water from all water supply and return lines.

A pool winterizing method for use with a pool having at least one skimmer unit, and at least one water jet; wherein said skimmer and water jets communicating with a pump/filter assembly with water supply lines and water return lines, said pool winterizing method comprising the following steps:

(a) attaching the modified skimmer lid claimed in claim 1 to pump skimmer chamber;

(b) connecting a source of compressed air to compressed air inlet;

(c) purging water return lines and supply lines with compressed air;

(d) plugging off skimmer unit for prevention of flow of water or air through said skimmer unit;

(e) plugging all water jets for prevention of flow of water or air through said water jets;

Preferably further including the following step inserted prior to step A:

(a) draining pool water to below the skimmer level.

Preferably further including the following step:

(f) disconnecting source of compressed air thereby terminating purging of supply and return lines.

BRIEF DESCRIPTION OF THE DRAWINGS

The invention will now be described by way of example only, with references to the following drawings in which.

DETAILED DESCRIPTION OF THE PREFERRED EMBODIMENT

Figure 1:
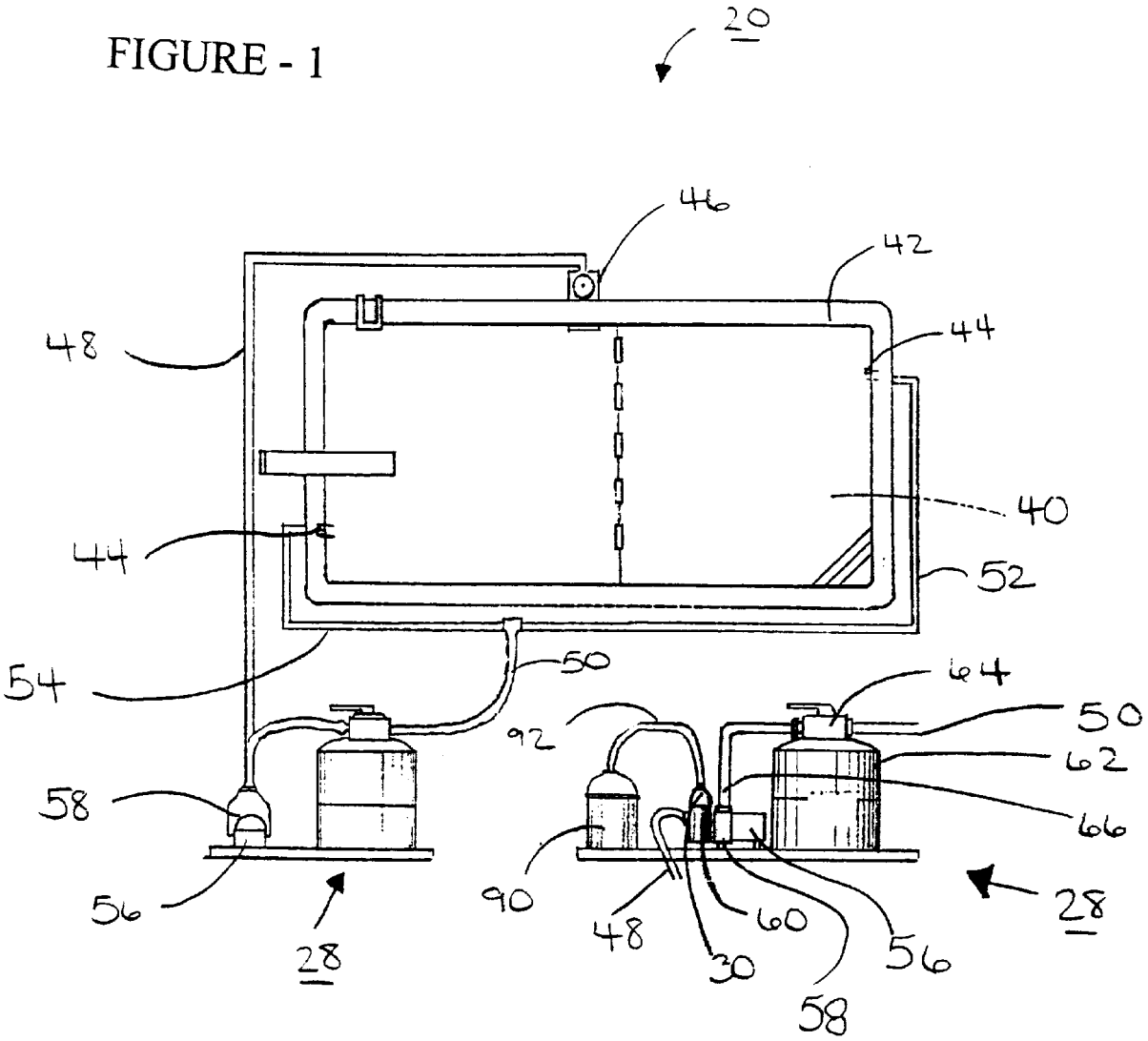
FIG. 1 is a schematic view of a pool together with a pump filter assembly showing the water return lines and the main supply lines together with the pump and filter.

The present invention, a pool winterizing method and apparatus is shown and described in FIGS. 1 through 8. The apparatus namely, a modified skimmer lid 30, together with pump skimmer chamber 60 and water pump 58 is shown in FIG. 1 deployed with a pump filter assembly 28 together with a conventional pool and associated plumbing.

I will now describe the environment in which the pool winterizing method and apparatus is deployed which is necessary for the understanding of the present invention.

Referring now to FIG. 1, the present invention, a pool winterizing apparatus namely, modified skimmer lid 30 is deployed with a conventional pump/filter assembly 28 together with a conventional pool 40 and the plumbing associated therewith.

Pool 40 has side walls 42 and normally a number of water jets shown in FIG. 1 as two water jets 44 and at least one skimmer unit 46.

Pump/filter assembly 28 operates to circulate water in and out of pool 40. Skimmer unit 46 receives water from pool 40 and communicates this water through water return line 48 to pump/filter assembly 28. Pump/filter assembly 28 supplies water to pool 40 by communicating water through main water supply line 50 to first supply line 52 and second supply line 54 and finally to water jets 44.

Pump/filter assembly 28 includes pump motor 56 which drives water pump 58 which receives water from pump skimmer chamber 60. Water pump 58 communicates water to filter 62 via pump to filter line 66. In addition, filter 62 normally has mounted thereon filter controls 64 which directs the water supply and also provides other functions such as back flushing of filter 62.

Figure 6:
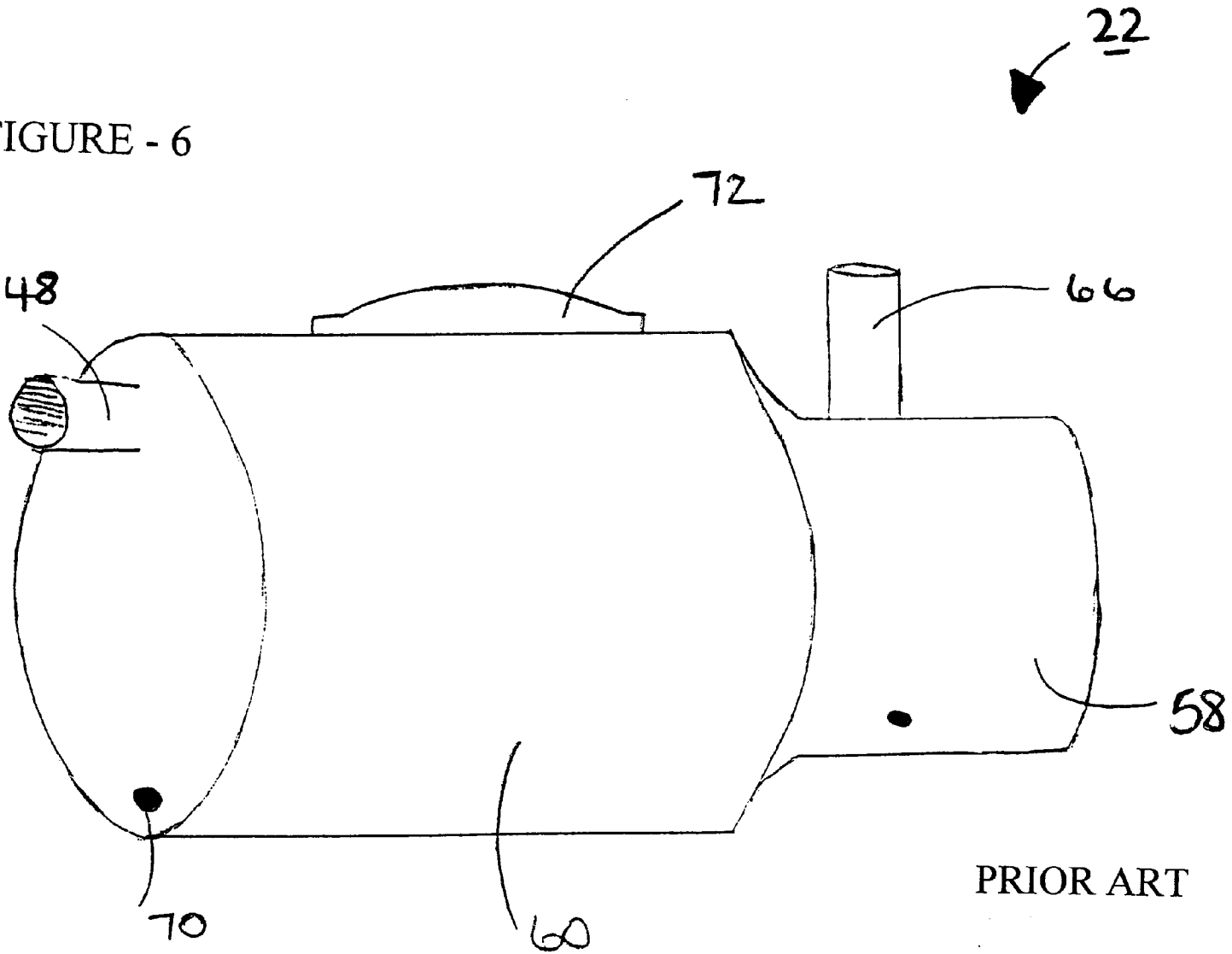
PRIOR ART FIGURE - 6
FIG. 6 is the pump assembly showing the prior arts skimmer lid and the conventional arrangement of the pump and skimmer chamber.

Referring now specifically to FIG. 6 which schematically depicts pump assembly 22 which is a conventional or prior art type arrangement. Pump assembly 22 includes pump skimmer chamber 60, water pump 58, pump to filter line 66, connection for water return line 48 and prior art skimmer lid 72.

Figure 2:
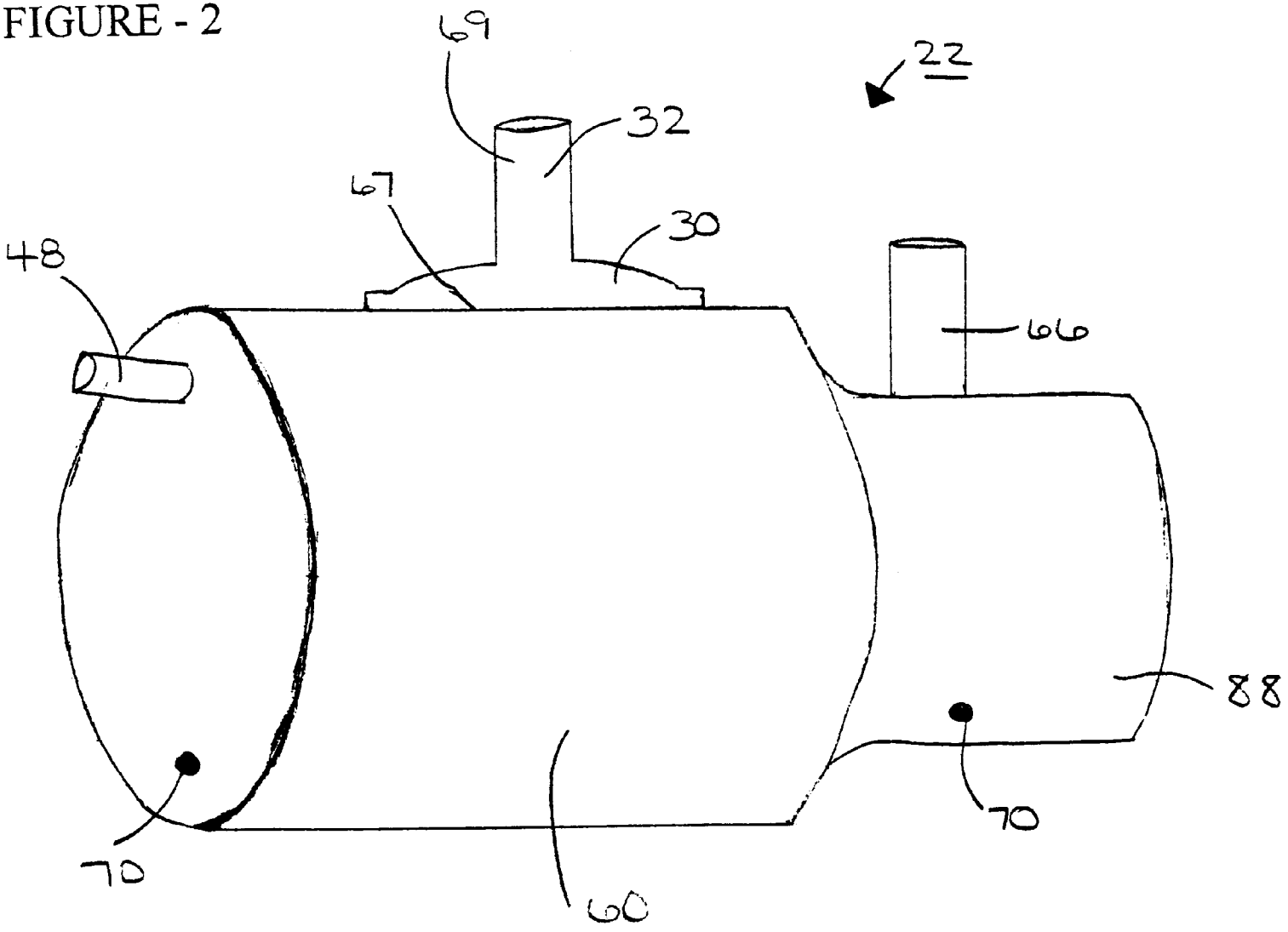
FIG. 2 is a schematic representation of the pump assembly showing the pump together with skimmer chamber as well as water and air supply and inlet lines.
Figure 3:
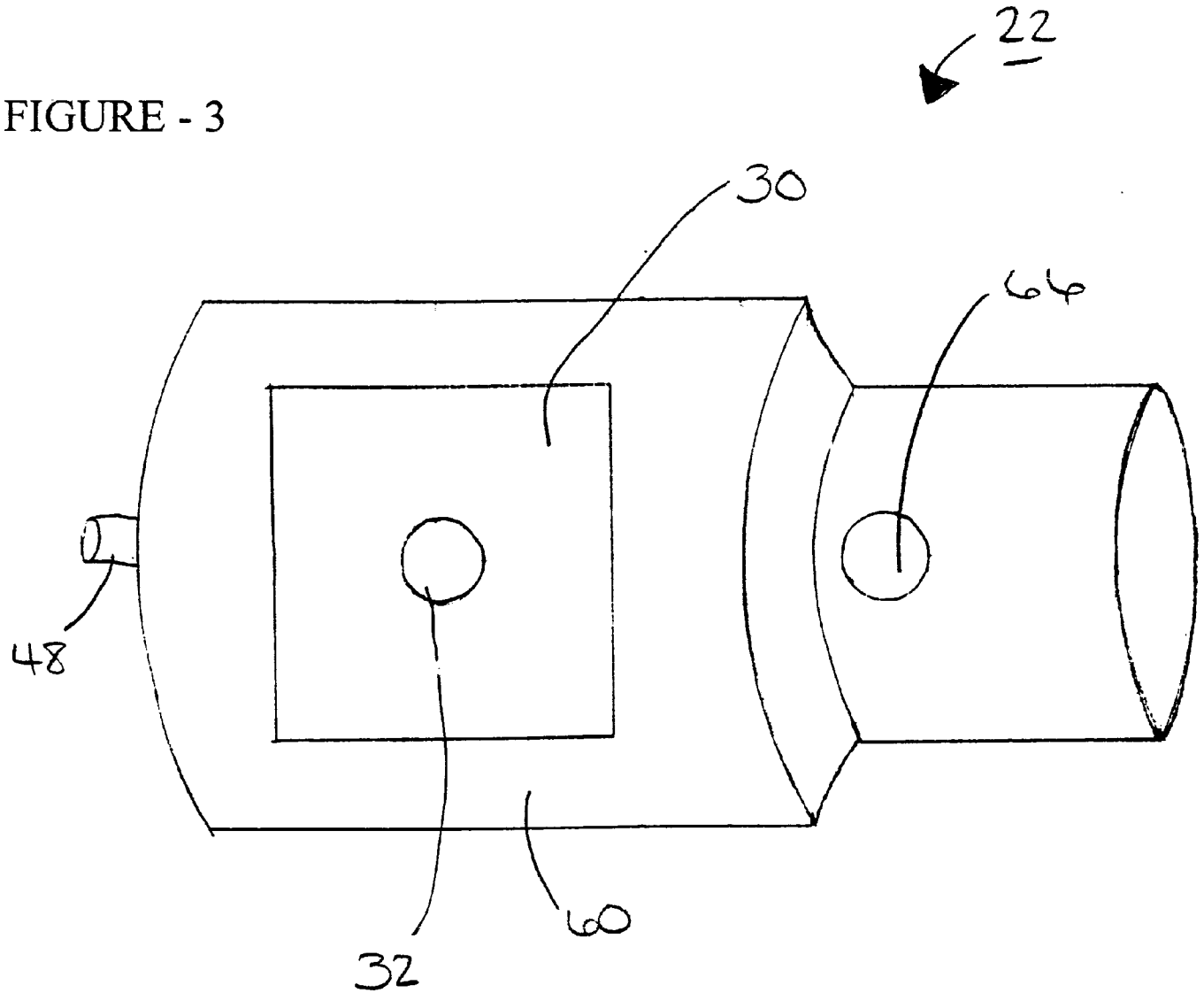
FIG. 3 is a schematic top view of the pump assembly showing the pump together with the skimmer chamber and the modified skimmer lid in place.

Referring now to FIGS. 2 through 5, pump assembly 22 includes pump skimmer chamber 60, water pump 58, winterizing drain 70, water return line 48, pump to filter line 66, modified skimmer lid 30, having a skimmer lid base 67 and compressed air inlet 32 in the form of connection pipe 69 mounted thereon. FIG. 3 shows the pump assembly 22 in schematic fashion in top view. Pump assembly 22 in this Figure includes pump skimmer chamber 60, water pump 58, water return line 48, pump to filter line 66, modified skimmer lid 30, having a mounted thereon compressed air inlet 32.

Figure 4:
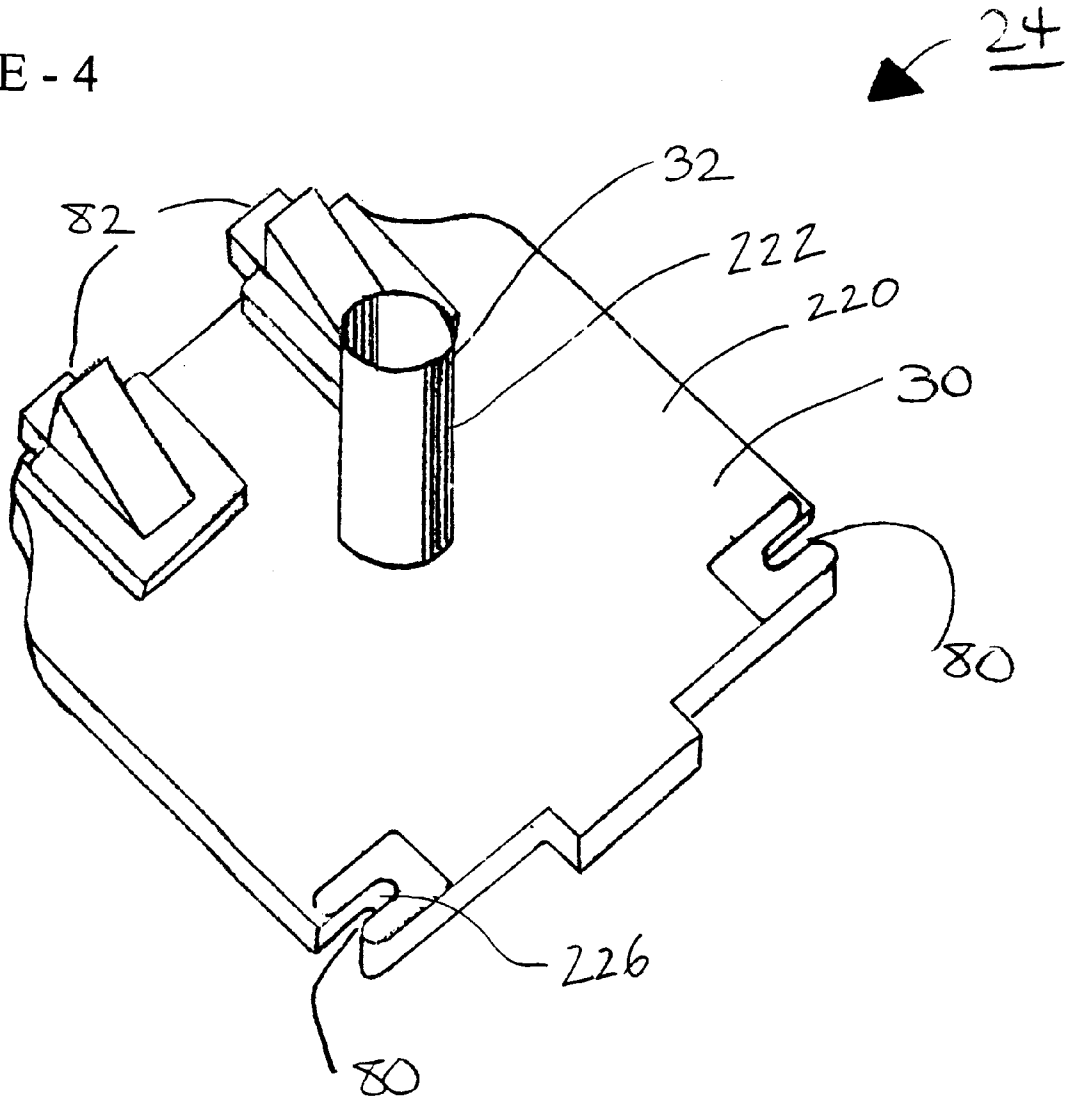
FIG. 4 is a schematic representation of a skimmer lid showing the modified skimmer lid design.
Figure 5:
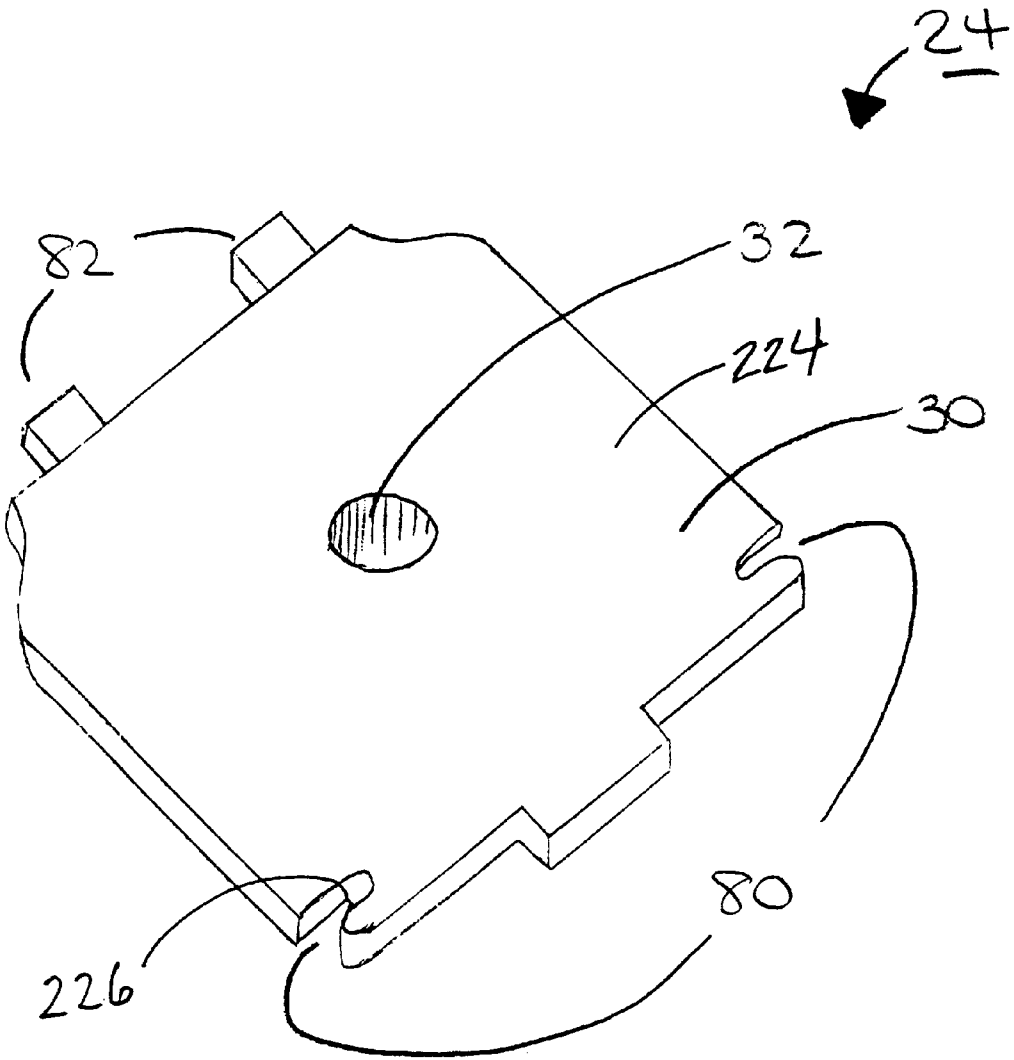
FIG. 5 is a bottom schematic representation of the skimmer lid showing the modified skimmer lid in the inverted position, viewing from underneath.

FIGS. 4 and 5 show in schematic fashion perspective views of skimmer lid 24 being the presently invented modified skimmer lid 30 including compressed air inlet 32. Modified skimmer lid 30 in addition has attachment flanges 82 as well as bolt recesses 80 which are used for the attachment of modified skimmer lid 30 to pump skimmer chamber 60. Referring now to FIG. 5, which is an inverted schematic perspective representation of skimmer lid 24, showing modified skimmer lid 30 having compressed air inlet 32, as well as bolt recesses 80 and attachment flanges 82.

Modified skimmer lid 30 is comprised of a planar base 220 having attached thereon or integrally part of base 220 and air inlet 32 which is comprised of an upstanding pipe 222 which communicates air to a skimmer chamber 60 shown in FIG. 2 Referring to FIG. 5, the bottom surface of planar base 220 is preferably a flat sealing surface 224 for sealing air tightly against skimmer chamber 60.

Preferably modified skimmer lid 30 has male attachment flanges 82 which cooperate to female indentations not shown in skimmer chamber 60 and as well both recesses 80 which are comprised of bolt slots 226 for screwably fastening down in a releasable fashion modified skimmer lid 30 onto skimmer chamber 60. Also not shown in the diagrams, it is also possible to have a closure for the end of air inlet 32 such that when air inlet 32 is not being used, a cap and/or other seal can be placed over the end of air inlet 32 thereby preventing flow of air or water through pipe 222. Such a cap could be threadably placed onto pipe 222 or securely fastened in a releasable fashion to pipe 222 in any matter known in the art.

Modified skimmer lid 30 is attached to skimmer chamber 60 by simply placing male attachment flanges 82 into the corresponding female slots in skimmer chamber 60 not shown and thereafter placing bolts through bolt recesses 80 which preferably are bolts slots 226 being slots defined in planner base 220 and thereby screwably fastening down planner base 220 against skimmer chamber 60 providing an air and water tight seal.

In use pool winterizing apparatus namely, modified skimmer lid 30 is used as follows. Prior art skimmer lid 72 which covers pump skimmer chamber 60 is removed in a conventional manner by loosening bolts and disconnecting the attachment flanges, thereby being able to remove and lift out of place prior art skimmer lid 72. Most commercially available, pump skimmer chambers 60, provide a prior art skimmer lid 72 which is removable and normally made out of a clear plastic material, in order to be able to view into pump skimmer chamber 60 to determine whether or not there is an excessive amount of debris trapped therein. The purpose of pump skimmer chamber 60 is to provide a final filtration of water received from the pool and to trap debris and contaminants in the water prior to allowing the water to flow into water pump 58. In the normal course of operation the prior art skimmer lid 72 is removed periodically in order to clean out debris found within pump skimmer chamber 60. Pump skimmer chamber 60 must be periodically cleaned out to maintain the pumping efficiency of water pump 58.

The current invention replaces prior art skimmer 72 with the presently invented modified skimmer lid 30 having compressed air inlet 32. The modified skimmer lid 30 is adapted to fit the existing pump skimmer chamber 60 and is of similar design so as to be easily attached via attachment flanges 82 and bolt recesses 80 analogous to prior art skimmer lid 72.

Figure 7:
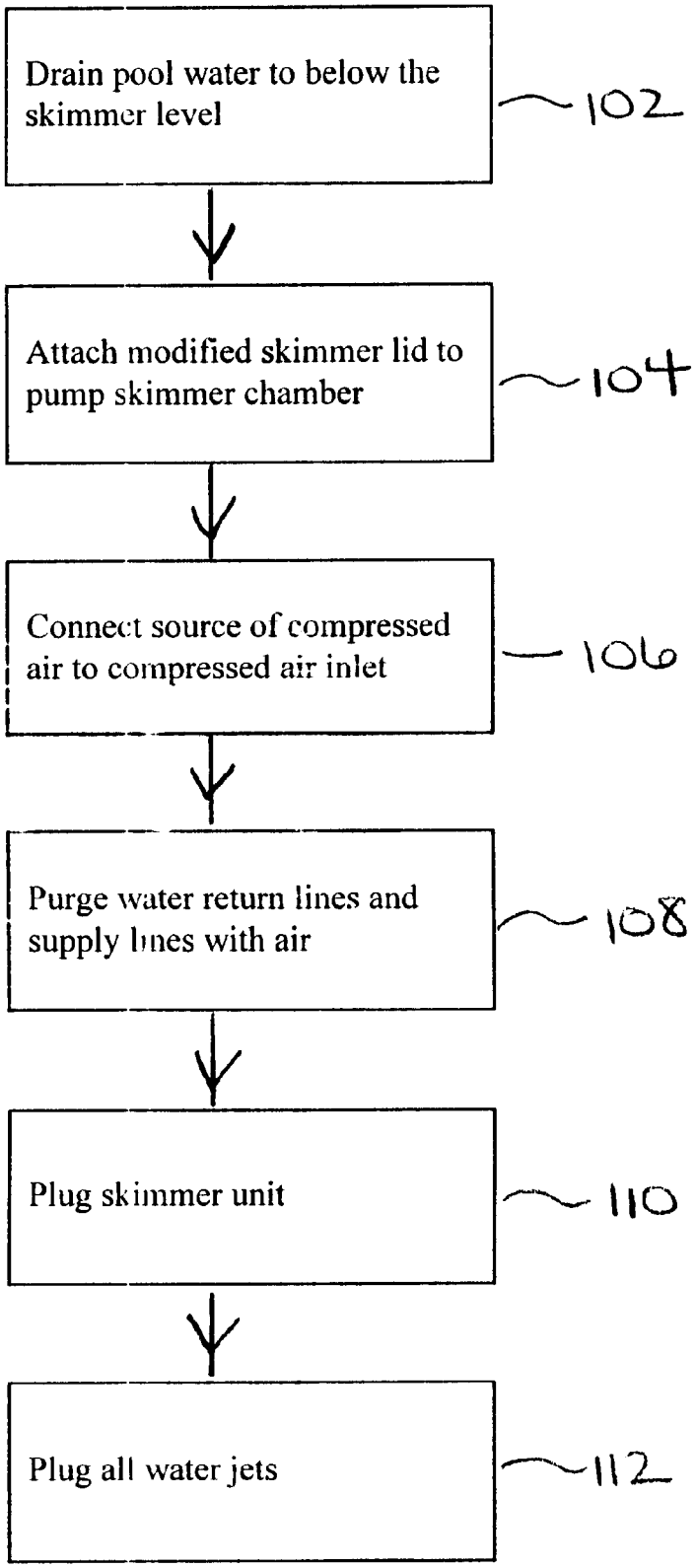
FIG. 7 is a schematic flow chart representation of a method for winterizing a pool.

The method for winterizing a pool is schematically depicted in a flow diagram in FIG. 7. In order to prepare the pool and all its ancillary equipment for freezing conditions, modified skimmer lid 30 is used to winterize the pool in the following method. Referring now to FIG. 7, the following steps 102 to 110 is the preferred method of winterizing a pool using the modified skimmer lid 30. Firstly, step 102 the pool water is drained below the skimmer level. Secondly, step 104, the prior art skimmer lid 72 is removed and modified skimmer lid 30 is attached to the pump skimmer chamber 60 and thirdly, step 106, a source of compressed air is connected to compressed air inlet 32. The source of compressed air in this case, can be any conventional vacuum cleaner which is used in reverse fashion, in other words the exit of the air discharge of the vacuum cleaner is connected to compressed air inlet 32. The air pressure developed at the discharge of a conventional domestic vacuum cleaner is great enough to overcome the static water head at both the skimmer unit 46 and water jets 44. In step 4, 108, compressed air inlet which is connected to vacuum cleaner 90 via purge line 92 receives compressed air from vacuum cleaner 90 and purges all water return lines and water supply lines with air. In particular, compressed air purges water return line 48 which communicates with skimmer unit 46 with air and also purges pump to filter line 66 which communicates with main water supply line 50 and first supply line 52 and second supply line 52 with air, therefore, purging these lines with air also. In step 5, 110, while compressed air is purging water return line 48, and skimmer unit 46, skimmer unit 46 is plugged in order to provide for an air tight seal between skimmer unit 46 and water pump 54. In step 6, shown as 112, while compressed air continues to purge main water supply line 50 and first supply line 52 and second supply line 54, water jets 44 are plugged with normally provided for threaded either metal or plastic plugs in order to provide for an airtight seal between water jets 44 and filter 62. In this step, the user will be able to visually observe air bubble rising through the water from water jets 44. The user will also be able to determine when an air tight seal has been established when the air bubble cease to emerge from water jets 44.

Optional once this method has been employed, filter 62, pump skimmer chamber 60, water pump 58, optionally and preferably can be drained using winterizing drain 70 which normally are present on all these units, this in fact will drain any residual water which resides in filter 62, pump skimmer chamber 60, and water pump 58.

The advantages with the current system are that none of the existing supply and/or return lines need to be unclamped or removed from their existing connections. The source of compressed air, namely vacuum cleaner 90, which connects to modified skimmer lid having a compressed air inlet 32 which eliminates the need for removing any of the existing supply and/or return lines including water return line 48, pump to filter line 66, main water supply line 50 and/or second supply lines 52 and 54.

A conventional pool winterizing methods require the removal of water supply and/or water return lines and normally includes the removal of just one end of pump to filter line 66 from water pump 58 or removal of a main water supply line 50 connected at filter control 64 and/or removal of water return line 49 connected at pump skimmer chamber 60. By utilizing modified skimmer lid 30, one eliminates the necessity for removing any lines from water pump 58 or pump skimmer chamber 48 or for that matter any lines whatsoever in the system.

The difficulty with attaching or removing supply or return lines is the possibility of fraying and/or damaging the lines themselves, the possibility of introducing leaks into the system and finally, eliminating premature failure of main water supply lines 50 or water return lines 48 due to not having introduce the stresses of attachment and removal of the ends every year.

Figure 8:
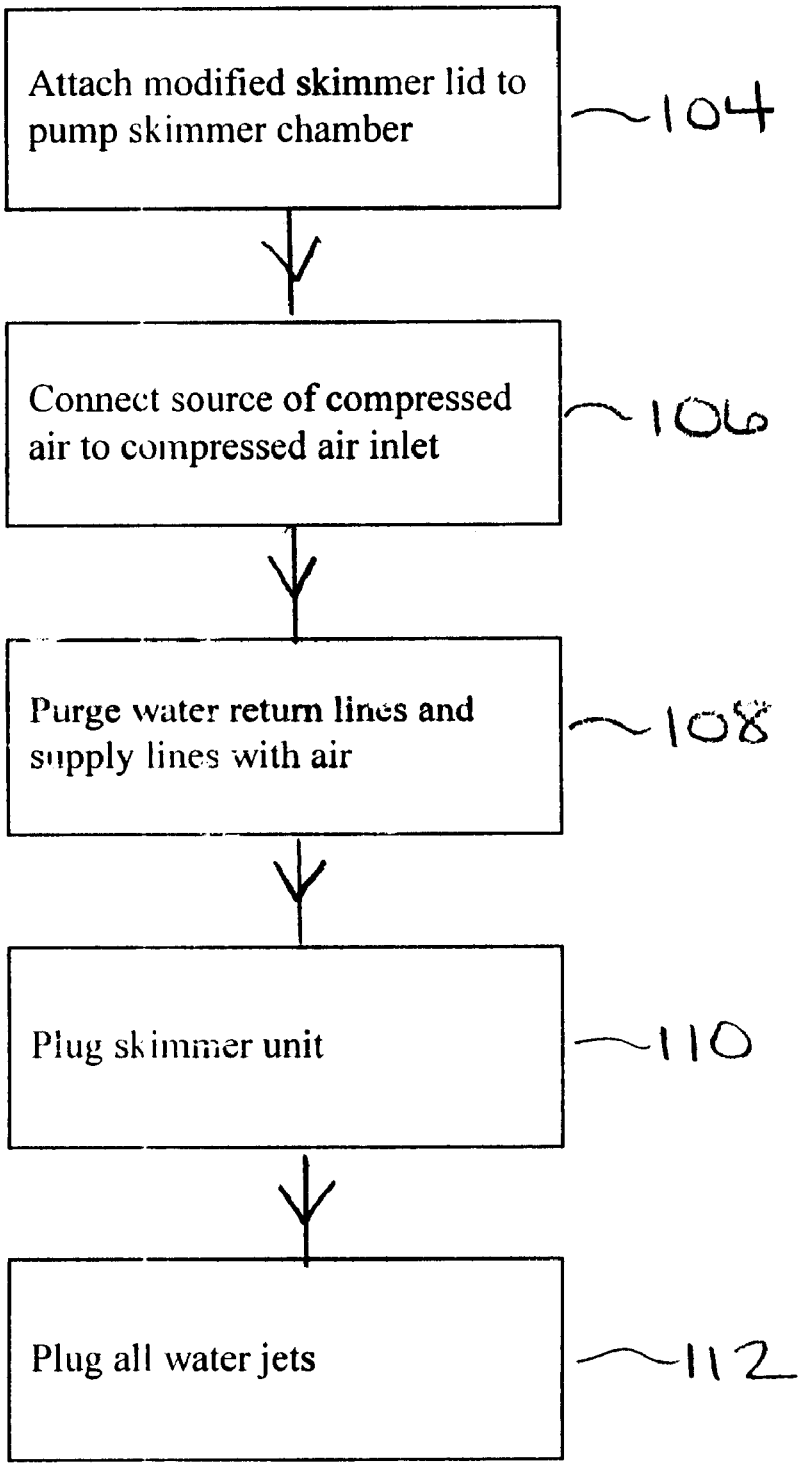
FIG. 8 is a schematic flow chart representation of a method for winterizing a pool.

Referring now to FIG. 8, first step 102, in FIG. 7 is removed and the method as described above is the same, other than the pool water level is not drained to below skimmer unit 46. It is possible to use modified skimmer lid 30 and winterizing a pool 40 without having to drain water from the pool whatsoever, however in practice it is preferable to drop the pool level by one or two inches making the winterizing process substantially easier.

A person skilled in the art in methods of winterizing swimming pools will recognize that the methods of winterizing swimming pool shown schematically in FIGS. 7 and 8 allow one to winterize a swimming pool without having to drop the water level below the jet nozzles of the pool. In fact if the method is used in FIG. 8, the water level in the pool does not need to be dropped at all, but rather the lines just need to be purged with the source of compressed air through air inlet 32 of modified skimmer lid 30 and as the lines are being purged each one is sequently plugged off beginning with the skimmer unit and then the water jets. The plugs used to plug off skimmer unit 46 and the water jets 44 are conventional plugs that are often supplied with the pool and/or are readily available for most pools. The function of the plug is to provide a air and water tight seal for the exit end of the skimmer unit 46 or the water jets 44 in order to prevent water entering into the water jets and/or return lines 48 over the winter season. One of the advantageous of this method of plugging off the skimmer unit 46 and the water jets 44 is that while the plugs are being put in place, bubbles can be detected escaping from the skimmer unit 46 or the water jets 44 as the plug is put in place, thereby telling the installer firstly that there is positive pressure in the line, evacuating any sources of water within the return lines 48 and secondly, when the bubbles stop appearing from the skimmer unit 46 or from the end of water jets 44, the installer of the plug will know that he has achieved water and air tight seal for that particular connection.

Additionally, a person skilled in the art will recognize that another major advantageous of this winterizing method is that none of the hoses connected to the filter, the skimmer unit, the pump or even the return lines water jets need to be disconnected or in any way disturbed in order to clear out water from all of the lines.

It should accordingly be apparent to persons skilled in the art that various modifications and adaptations of the structure described above are possible without departure from the spirit of the invention the scope of which is defined in the appended claims.

I claim:

1. A modified skimmer lid for use with a pool pump assembly having a pump, a pump skimmer chamber and a removable pump skimmer lid for the skimmer chamber, the modified skimmer lid comprising:

(a) a skimmer lid base adapted to seal and mate with a pump skimmer chamber, and (b) a conduit means for communicating and introducing compressed air from a source of compressed air into said pump skimmer chamber; and for purging existing pool lines with compressed air, such that existing water lines need not be disturbed or removed.

2. The modified skimmer lid claimed in claim 1 wherein said conduit means comprises:

(a) a compressed air inlet integrally part of said modified skimmer lid for communicating and introducing compressed air into said pump skimmer chamber.

3. The modified skimmer lid claimed in claim 2 wherein said compressed air inlet including a connection pipe for receiving and communicating compressed air into said skimmer chamber.

4. The modified skimmer lid claimed in claim 3 wherein said connection pipe adapted for communication of exhaust air received from a vacuum cleaner into said skimmer chamber.

5. The modified skimmer lid claimed in claim 4 further comprising:

(a) said skimmer lid base including a planar base have a sealing surface for providing an air and water tight seal with said skimmer chamber;

(b) said planar base further including male attachment flanges cooperatively engaging with female apertures in said skimmer chamber for engaging one end of said modified skimmer lid; and (c) said planar base including bolt recesses including bolt slots for receiving fastening bolts there through for releasably attaching said skimmer lid to said skimmer chamber.

6. In combination, the modified skimmer lid claimed in claim 1 and a pool winterzing assembly comprising:

(a) a pump/filter assembly including said modified skimmer lid mounted on said skimmer chamber;

(b) a pool including at least one skimmer unit, and at least one water jet; wherein said skimmer unit and water jets communicating with said pump/filter assembly with water supply lines and water return lines; and (c) a source of compressed air communicating air to said modified skimmer lid and into said skimmer chamber for purging residual water from all water supply and return lines.

7. The pool winterizing assembly claimed in claim 6 in combination with the modified skimmer lid claimed in claim 2.

8. The pool winterizing assembly claimed in claim 6 in combination with the modified skimmer lid claimed in claim 3.

9. The pool winterizing assembly claimed in claim 6 in combination with the modified skimmer lid claimed in claim 4.

10. The pool winterizing assembly claimed in claim 6 in combination with the modified skimmer lid claimed in claim 5.

11. A pool winterizing method for use with a pool having at least one skimmer unit, and at least one water jet; wherein said skimmer unit and water jets communicating with a pump/filter assembly with water supply lines and water return lines, said pool winterizing method comprising the following steps:

(a) attaching the modified skimmer lid claimed in claim 1 to a pump skimmer chamber;

(b) connecting a source of compressed air to a compressed air inlet;

(c) purging said water return lines and supply lines with compressed air;

(d) plugging off said skimmer unit for prevention of flow of water or air through said skimmer unit;

(e) plugging all water jets for prevention of flow of water or air through said water jets.

12. The pool winterizing method claimed in claim 11 further including the following step inserted prior to step A:

(a) draining pool water to below the skimmer unit level.

13. The pool winterizing method claimed in claim 11 or 12 further including the following step:

(a) disconnecting source of compressed air thereby terminating purging of supply and return lines.

* * * * *